US005522435A

United States Patent [19]

DeRudder

[11] Patent Number: 5,522,435

[45] Date of Patent: Jun. 4, 1996

[54] MACHINE FOR WEAVING FACE TO FACE FABRICS

[75] Inventor: Carlos DeRudder, Heule, Belgium

[73] Assignee: N.V. Michel Van de Wiele, Kortrijk-Marke, Belgium

[21] Appl. No.: 232,617

[22] Filed: Apr. 25, 1994

[30] Foreign Application Priority Data

Apr. 23, 1994 [BE] Belgium ..... 09300411

[51] Int. Cl.[6] ..... D03C 3/00

[52] U.S. Cl. ..... 139/65; 139/21

[58] Field of Search ..... 139/59, 65, 83, 139/21

[56] References Cited

U.S. PATENT DOCUMENTS 5,038,837 8/1991 Palau ..... 139/65
5,092,369 3/1992 Derudder ..... 139/65
5,139,052 8/1992 Derudder ..... 139/65
5,222,526 6/1993 Derudder ..... 139/65

*Primary Examiner*—Andy Falik
*Attorney, Agent, or Firm*—Brumbaugh, Graves, Donohue & Raymond

[57] ABSTRACT

A Jacquard machine for weaving face-to-face fabrics consisting of a bottom fabric and a top fabric between which pile threads are stretched, incorporating two systems, one for each fabric. For each pile thread, the machine incorporates a selection element with hooks under the action of knives, a cord which is connected to one of the hooks, a lifting device, and a grate which is driven together with one of the knives. The invention enables pile warp threads to be taken into more than three different positions with the aid of a single selection element, thereby reducing the cost and size of the Jacquard machine.

20 Claims, 6 Drawing Sheets

B
MB
MO
O
L
L/2
G1
G2
G3

G11
G21
G31
G41

0W 1,5L

BW

B
M1
M2
M3
0

MACHINE FOR WEAVING FACE TO FACE FABRICS

BACKGROUND OF THE INVENTION

1. Description of the Prior Art

The invention relates to a device by means of which the pile warp threads can be taken into more than three different positions with the aid of a selection element with interacting complementary hooks on a movable lifting device (which form an open-shed element) and two vertically movable grates to which a reversing roller is immovably connected.

French Patent No. 1,050,774 discloses how four positions can be obtained with two hooks or two selection elements, a movable bottom board and a lifting device. The disadvantage of this device is that two selection elements are needed in each case. In the case of an electronic Jacquard machine, for example, this becomes very expensive.

Belgian Patent Application No. 09200461 (unpublished on Apr. 23, 1993) discloses how three different positions of the pile warp threads can be obtained with a selection element and two interacting complementary hooks on said selection element which are connected to a movable lifting element with a vertically movable grate to which a reversing roller is immovably connected.

The object of the invention is to improve these devices in such a way that they are capable of more than three positions while only one selection element is necessary.

SUMMARY OF THE INVENTION

The object of the invention is to improve on the prior art devices by in that the Jacquard machine is capable of placing pile threads in more than three positions, while only one selection element is needed.

The Jacquard machine for weaving two fabrics between which pile threads extend, is provided with, for each pile thread, a device such as a harness cord from which a heald is suspended, and an element for placing each heald and, thus, each pile thread, in several positions.

The machine according to the invention comprises a first system for binding a first series of pile threads into a first fabric, and a second system for binding a second series of pile threads into a second fabric. Each the two systems have the following elements:

- a selection element with two vertically movable complementary hooks under the action of two knives, which move in counterphase in an up and down movement;
- a cord-and-pulley element, which comprises
  - a movable lifting element having a top roller and
  - a bottom roller,
  - a pulley cord, which connects said complementary hooks, said pulley cord being passed under the top roller of said movable lifting element,
  - a reversing roller located below the movable lifting element, and
  - a position cord which is connected to one of the complementary hooks and passed under the reversing roller, then over the bottom roller of the movable lifting element, and then down to the heald device from which the heald is suspended;
- a vertically movable grate, to which the reversing roller is attached; and
- means for moving the grate with one of the two knives.

The first system is adapted so that it is able to position the heald device among three positions, namely a top position, a bottom position, and a first intermediate position. The second system is adapted so that it is able to position the heald device among three positions, namely the top position, the bottom position, and a second intermediate position.

The grates are preferably connected in such a way to one of the two knives that a lift of the knife over a certain length corresponds to a lift of the grate of the second system which differs from the lift of the grate of the first system.

Other features and details of the invention will emerge from the description which follows with reference to the appended drawings.

DESCRIPTION OF THE PREFERRED EMBODIMENTS

Figure 1:
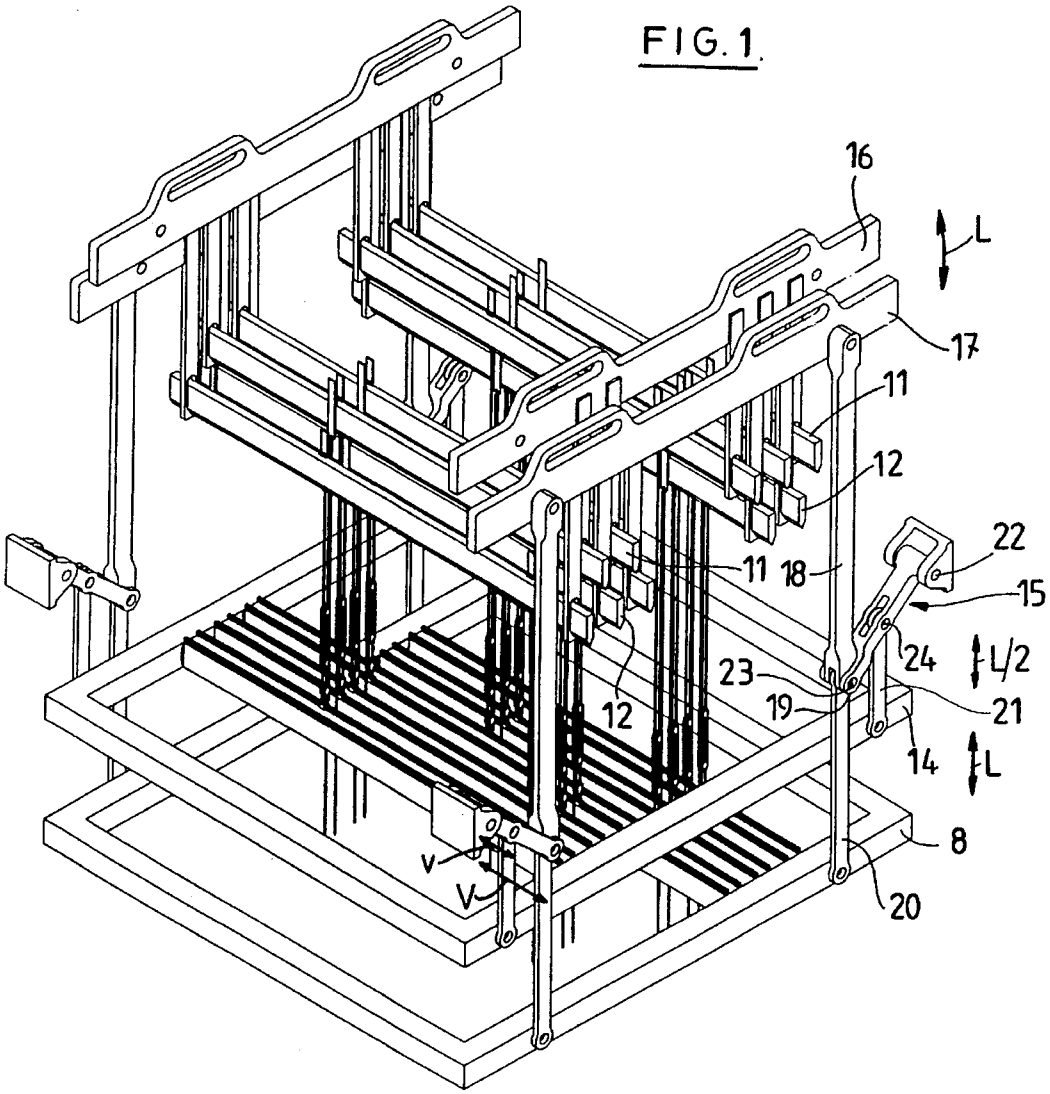
FIG. 1 shows in perspective a part of a Jacquard machine according to the invention.
Figure 3:
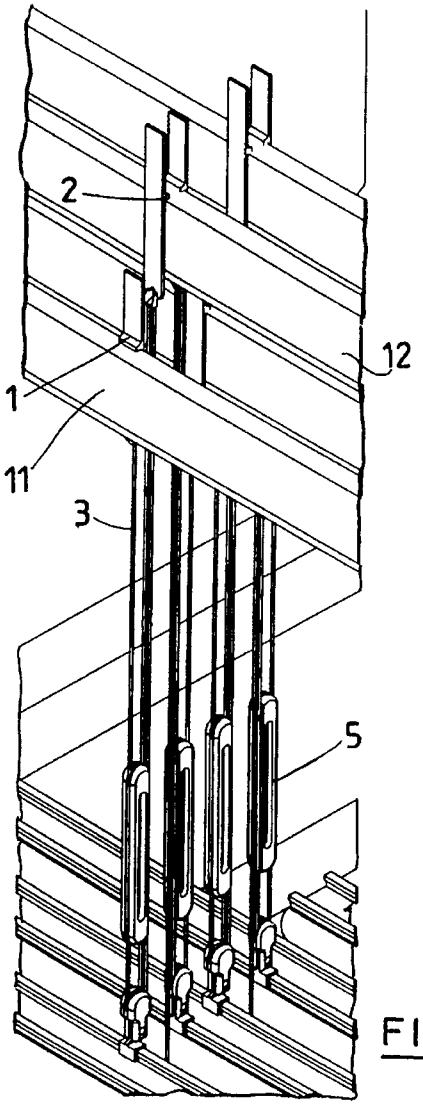
FIG. 3 shows a part in perspective from FIG. 1, but enlarged.
Figure 2:
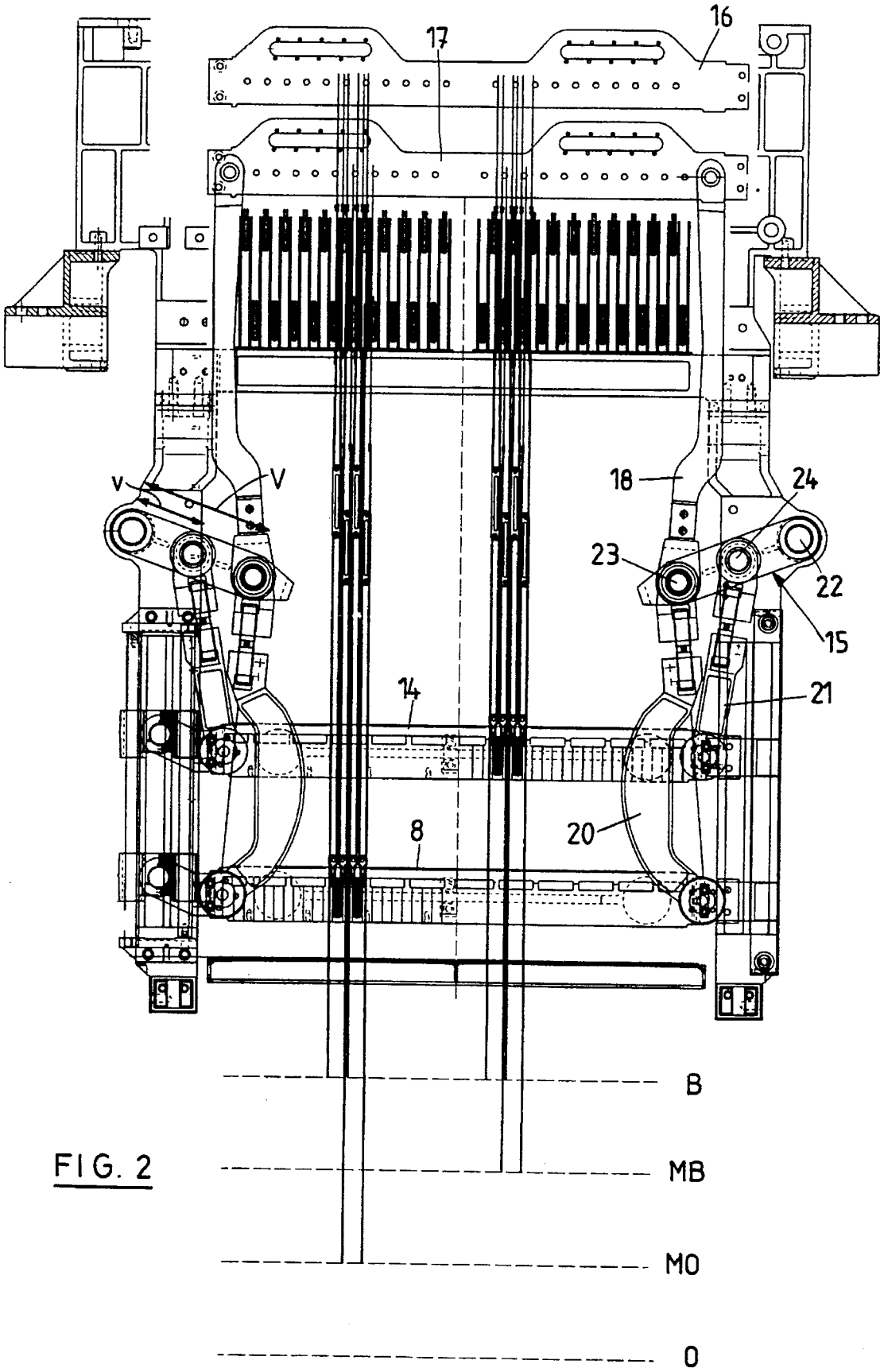
FIG. 2 shows a side view of the part illustrated in FIG. 1.

The Jacquard machine which is shown partially in FIG. 1 is designed for weaving of face-to-face carpet or velvet, consisting of a bottom fabric and a top fabric between which pile threads are stretched.

Each pile thread passes through a heald which is linked to a system by means of which the vertical position of the heald can be controlled.

For the pile threads which are provided for binding into the bottom fabric the system comprises:

—a selection element with two vertically movable complementary hooks 1, 2 under the action of two knives 11, 12 moving in counterphase, in an up and down movement B; the hooks 1, 2 are connected by a cord 3 which is passed round the top roller 4 of a movable lifting element 5;

—a cord 6 which is connected to one (2) of the complementary hooks is passed round a reversing roller 7 fixed to a first vertically movable grate 8, and is then passed over the bottom roller 9 of the movable lifting device 5 and run to the heald 13; and —the first vertically movable grate 8 is driven by one (12) of the upgoing and downgoing knives.

Figures 4, 5, 6, 7, 8, 9, 10, 11:
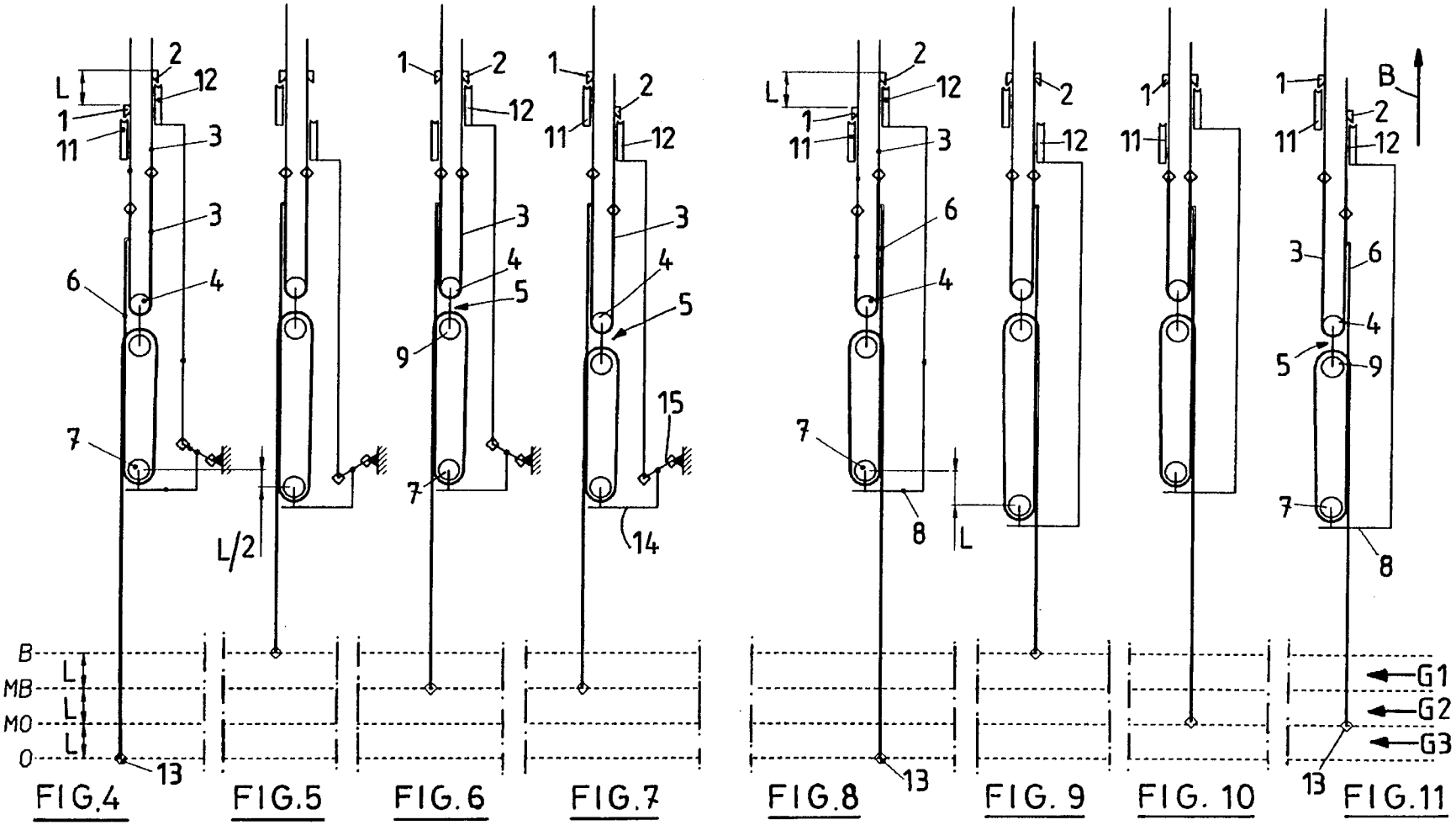
FIGS. 4 to 11 show working steps of the machine shown in FIG. 1.

Three positions for the heald 13 can be obtained by means of this system, namely a bottom position O when the knife 11 is lowered while hook 1 is not selected (FIG. 8), a top position B when the knife 12 is lowered while hook 2 is selected (FIG. 9), and a bottom middle position MO when knife 11 is lowered while hook 1 is selected or when knife 12 is lowered while hook 2 is not selected (FIGS. 10 and 11).

For the pile threads which are provided for binding into the top fabric the system comprises:

—a selection element with two vertically movable complementary hooks 1, 2 under the action of two knives 11, 12 moving in counterphase, in an up and down movement; the hooks are connected by a cord 3 which is passed round the top roller of a movable lifting element;

—a cord 6 which is connected to one (1) of the complementary hooks, and is passed round a reversing roller fixed to a second vertically movable grate 14, and is then passed over the bottom roller 9 of a movable lifting device and run to the heald 13;

—the second vertically movable grate 14 driven by one of the upgoing and downgoing knives 11, 12 and to which the reversing roller is connected, and —a mechanism 15 which is connected to the second grate 14 and is driven together with a knife (12).

In one embodiment, the mechanism comprises a lever which is rotatable relative to a shaft and which is connected to a knife and a grate in such a way that a vertical movement of the knife over a length (L) corresponds to a vertical movement of the grate over a distance which differs from the above-mentioned length (L).

According to one feature of said embodiment, the second grate is rotatably connected to a rod which is rotatably connected to the lever.

According to another feature of said embodiment, a knife of the selection element of the second series of elements, or a piece supported by said knife, is rotatably connected to a rod, which rod (hereinafter called rod of the knife) is rotatably connected to the lever.

According to one embodiment, the ratio between the distance between the shaft of the lever and the pivot point of the rod of the knife on the lever and the distance between the shaft of the lever and the pivot point of the rod of the grate on the lever is higher than 1.1 or lower than 0.9. Said ratio preferably lies between 0.2 and 0.9 and between 1.1 and 2. In particular, the ratio is approximately 0.5 or 1.5.

According to a specific embodiment, the first grate is driven in such a way together with one of the upgoing and downgoing knives with lift L that it moves over a length L, while the second grate is driven in such a way together with one of the upgoing and downgoing knives with lift L that it moves over a length L/2 or 1.5 L.

In a preferred embodiment, the first grate and the second grate are driven by the same system, in which a series of first knives of the selection elements of the first elements and a series of first knives of the selection elements of the second elements move in phase over a certain length (L), while a series of second knives of the selection elements of the first elements and a series of second knives of the selection elements of the second elements move in phase over the above-mentioned length (L), which movement of said second knives is in counterphase to the movement of the above-mentioned first knives.

Other features and details of the invention will emerge from the description which follows with reference to the appended drawings.

Three positions for the heald 13 can be obtained by means of this system, namely a bottom position 0 when the knife 11 is lowered while hook 1 is not selected (FIG. 4), a top position B when the knife 12 is lowered while hook 2 is selected (FIG. 5), and a top middle position MB when knife 11 is lowered while hook 1 is selected, or when knife 12 is lowered while hook 2 is not selected (FIGS. 6 and 7).

The knives 11 are fitted on a carrier 16, while the knives 12 are fitted on a carrier 17, the knives being driven by a single drive system so that the knives and the knives 12 move in counterphase.

The grates 8, 14 are connected to the carrier 7 by means of rods 18.

The mechanism 15 comprises a lever which is mounted on a shaft 22, so that said lever is rotatable relative to the frame of the machine (not shown).

A first rod 18 extends between the carrier 17 and the free end 19 of the lever 15. Said rod 18 is rotatably connected to the carrier 17, and also to the lever 15. The lever 15 is rotatably connected to the grates 8, 14 by rods 20, 21. The rod 20, which is rotatably connected to the grate 8, is connected to the shaft 23 forming the connection between the lever 15 and the rod 18, while the rod 21 is rotatably connected to the lever by means of a shaft 24 lying between the shaft 23 and the shaft 22. The ratio between the distance v between the shaft 22 or pivot point of the lever and the pivot point of the rod 21 on the lever 15 and the distance V between the shaft 22 or pivot point of the lever 15 and the shaft 23 is 0.5, so that a vertical movement of the knives 12 over a length L corresponds to a vertical movement of the grate 8 over a length L and to a vertical movement of the grate 14 over a length L/2.

FIGS. 4 to 7 show the positions of the heald 13 for a pile thread provided for binding into the top fabric.

In FIG. 4 the knife 11 is in the bottom position, while the knife 12 is in the high position. In that way the heald 13 is in its bottom position O (lie of active pile thread shown in FIG. 12).

FIGS. 6 and 7 show the position of the system for binding a pile thread into the top fabric. The heald 13 is in a position lying between the bottom position O and the top position B. The distance between that position MB and bottom position O is 2×L, while the distance between that position and the top position is 1×L.

Figure 13:
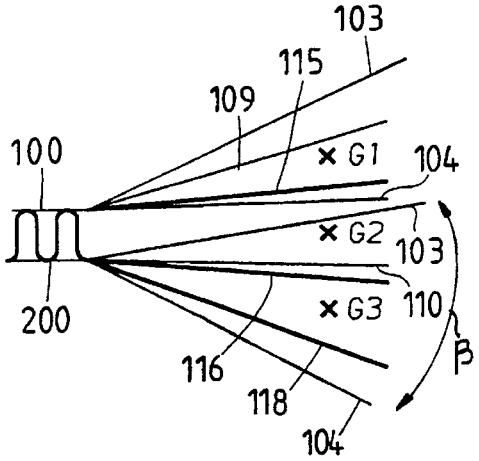

FIG. 5 shows the position of a thread which is provided for binding into the top fabric and forms pile on shot No. 2 (FIG. 13). This thread must be in top position B. Between shot No. 1 and shot No. 2 knife 11 and knife 12 have changed position. Hook 2 is selected by a selection element of the system and thereby remains at the top. Hook 1 has risen along with knife 11, and has thereby risen over distance L. Cord 6 has consequently risen a distance L, and heald 13 has thus risen a distance L. Cord 3 has also risen a distance L, with the result that hoist 5 rises L/2 and by way of cord 6 heald 13 thus again rises L. Due to the fact that knife 12 has dropped over distance L, grate 14 has dropped over distance L/2 and by way of roller 7 and cord 6 the heald 13 thus again rises L. So heald 13 has risen a total of 3×L and is therefore situated in top position (B).

FIG. 6 shows the situation of a pile thread which is provided for binding into the top fabric and is bound in on shot No. 1. This thread must be in top middle position (MB).

Compared with the situation in FIG. 4, knives 11 and 12 are in the same position, as is grate 14. However, hook 1 is selected by a selection element of the system and is thus L higher up than the position in FIG. 4. The result is that cord 6 has risen L, and heald 13 has thus risen L. Cord 3 has also risen L, with the result that hoist 5 rises L/2, and by way of cord 6 heald 13 thus again rises L. In total, the heald in the situation in FIG. 6 is thus 2 L higher than in the situation in FIG. 4, i.e. in position MB.

FIG. 7 shows the situation of a pile thread which is provided for binding into the top fabric and is bound in at shot No. 2. This thread must be in top middle position (MB).

For comparison with the situation in FIG. 5, hook 2 is not selected, with the result that it is L lower than in the situation in FIG. 5. This means that hoist 5 is L/2 lower, and heald 13 is thus L lower than the situation in FIG. 5, i.e. in position MB.

FIGS. 8 to 11 show positions of the heald 13 for a pile thread which is provided for binding into the bottom fabric (bottom position O—FIG. 8; top position B—FIG. 9) and for a pile thread bound into the bottom fabric.

On shot No. 1 knife 11 is down and knife 12 is up (FIG. 8). The difference in position between the two is L. The hook 1 rests on knife 11, and the hook 2 rests on knife 12. Book 1 and hook 2 are connected by way of a cord 3. Hook 2 is also connected to cord 6, which is connected to the heald 13 by way of the roller 7 and hoist 5. Roller 7 is fixed to a movable grate 8 which is immovably fixed to knife 12 by way of a rod. Grate 8 thus makes the same movement as knife 12.

FIG. 8 shows the position of a pile thread which is provided for binding into the bottom fabric and forms pile on shot No. 1. This thread must be in bottom position (O).

FIG. 9 shows the situation of a thread which belongs to the bottom fabric and forms pile on shot No. 2. This thread must be in top position (B). Between shot No. 1 and shot No. 2 knife 11 and knife 12 have changed position. Book 2 has been selected by a selection element and therefore remains at the top. Book 1 has risen along with knife 11 and has therefore risen L. This means that cord 3 has risen L, with the result that hoist 5 rises L/2, and by way of cord 5 heald 13 has consequently risen L. Due to the fact that knife 12 has dropped over distance L, grate 8 has dropped over distance L, and by way of roller 7 and cord 5 heald 13 has thus again risen 2 L.

In total, heald 13 has thus risen a distance 3×L, so it is situated in top position (B).

FIG. 10 shows the situation of a pile thread which is provided for binding into the bottom fabric and is bound in on shot No. 1. This thread must be in bottom middle position (MO).

For comparison with the situation in FIG. 8, knives 11 and 12 are in the same position, as is grate 8. However, hook 1 has been selected by a selection element and is thus situated L higher than in the situation in FIG. 8. This means that cord 3 has risen L, and heald 13 has thus risen L, with the result that the latter is in position MO.

FIG. 11 shows the position of a pile thread which is provided for binding into the bottom fabric and is bound in on shot No. 2. This thread must be in bottom middle position (MO).

For comparison with the situation in FIG. 9, hook 2 is not selected here and is therefore L lower than in the situation in FIG. 9, with the result that cord 6 has dropped L, so that heald 13 has dropped L. Cord 3 has also dropped L, with the result that hoist 5 drops L/2, and by way of cord 6 heald 13 thus drops L again. In all, heald 13 has thus dropped 2×L compared with the situation in FIG. 9, and is thus in position MO.

The Jacquard machine according to the invention can reach 4 positions:

* On shot 1 the positions O and MB are possible for pile threads which are provided for binding into the top fabric, and the positions O and MO are possible for pile threads which are provided for binding into the bottom fabric (see FIGS. 12 and 13, FIGS. 4, 6, 8 and 10).
* On shot 2 the positions B and MB are possible for threads of the top fabric, and the positions B and MO are possible for threads of the bottom fabric (see FIGS. 14 and 15, FIGS. 5, 7, 9 and 11).

Methods using the machine according to the invention of FIG. 1 are shown diagrammatically in FIGS. 12 to 15. These methods require two weaving loom cycles for making a pile thread from the top fabric or the bottom fabric form pile, or for binding it in.

Figure 12:
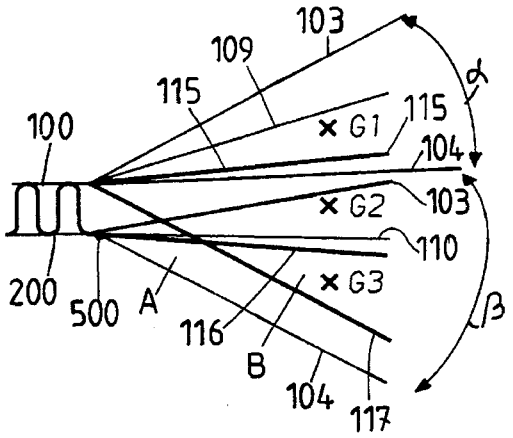
FIGS. 12 to 15 show the lie of the pile threads during weaving with the Jacquard machine with four positions.
Figure 14:
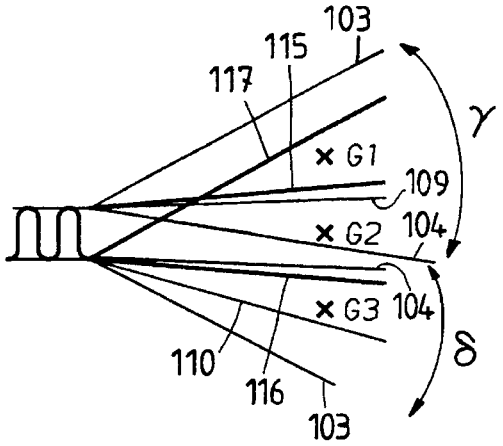
Figure 15:
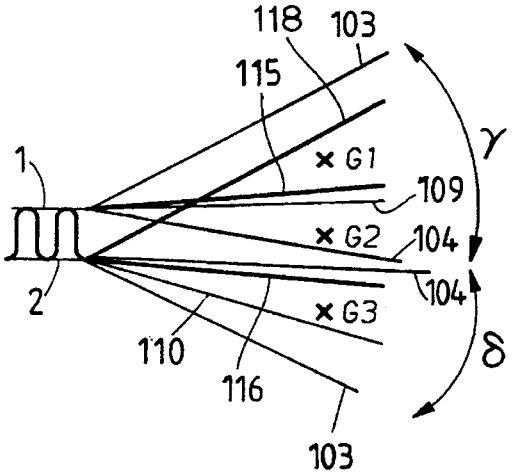

FIGS. 12 and 13 show a first shot of a method for binding in an active pile thread 117 from the top fabric 100 and an active pile thread 118 from the bottom fabric 200, while FIGS. 14 and 15 show the second shot for the pile threads.

In the method, weft threads are inserted by stationary grippers G1, G2, G3 between binding warp threads 103, 104 in order to tie off the pile threads.

In FIGS. 12 and 13 the binding threads 103, 104 of the top fabric 100 are given a lift such that they cross each other and the shed α defined between the binding threads 103, 104 allows gripper G1 to pass, and binding threads 103, 104 of the bottom fabric 200 are given a lift such that the shed β defined between the binding threads allows the grippers G2 and G3 to pass. Three weft threads can be inserted simultaneously by these grippers.

The tension warp thread 109 of the top fabric 100 extends in the vicinity of the binding thread 103 of the top fabric 100 above the grippers G1, while the bound-in pile thread 115 in the top fabric extends in the vicinity of the binding thread 104 below the gripper G1, so that the gripper G1 can be moved into the shed formed between the tension warp thread 109 and the bound-in pile thread 115.

The tension warp thread 110 of the bottom-fabric 200 and the bound-in pile thread 116 in the bottom fabric are taken into a position between the grippers G2 and G3, binding warp thread 3 above G2, binding warp thread 4 and pile warp thread 117 below G3, so that a double shed is formed for the bottom fabric.

During the second shot (see FIGS. 14 and 15) the binding threads 103, 104 of the top fabric 100 and the binding threads 103, 104 of the bottom fabric 200 are moved in such a way that the binding threads 103, 104 of the bottom fabric 200 cross each other, and the shed γ defined between the binding threads 103, 104 of the top fabric 100 and the shed δ defined between the binding threads 103, 104 of the bottom fabric 200 allow through two grippers G1, G2 for the top fabric (thus two weft threads) and the gripper G3 for the bottom fabric respectively.

The lie of the tension warp thread 109 of the top fabric 100 and the bound-in pile thread 115 in the top fabric 100 is adapted in such a way that the tension warp thread 109 and the pile thread 115 extend between the weft threads inserted by the grippers G1, G2.

The tension warp thread 110 of the bottom fabric extends in the vicinity of the binding thread 103 of the bottom fabric 200, while the bound-in pile thread 116 in the bottom fabric extends in the vicinity of the binding thread 104, so that the gripper G3 can be moved into the shed δ defined between the tension warp thread 110 and the pile thread 116.

In order to bind a pile thread 117 from the top fabric 100, the lie of said thread 117 is adapted in such a way that during the first shot (FIG. 12) two grippers G2, G3 are allowed through into the shed defined between the pile thread 117 and the binding thread 103 of the bottom fabric 200, and during the second shot (FIG. 14) two grippers G1, G2 are allowed through into the shed defined between the pile thread 117 and the binding thread 104 of the top fabric.

As can be seen from FIGS. 12 and 14, for each shot a pile thread 117 is moved in such a way relative to the last inserted weft threads that said pile thread rests on a weft thread of a fabric and runs to the tension warp thread of the other fabric in order to divide the shed defined between the binding threads of the other fabric into a first part lying between an intersection of the binding threads of the fabric and the pile thread, and into a second part which relative to the pile thread lies in a direction opposite to the above-mentioned intersection, in order to permit the insertion of one or two weft threads into the abovementioned part.

A pile thread 118 from the bottom fabric can be bound in, for example, as follows:

During a first shot, the lie of the thread 118 is adapted so that said thread lies next to the binding thread 104 of the bottom fabric, and so that two grippers G2, G3 are allowed through into the shed defined between the thread 118 and the binding thread 103 of the bottom fabric 200 (FIG. 13).

In a second shot, the lie of the thread 118 is adapted in such a way that the thread 118 lies next to the binding thread 103 of the top fabric, and the two grippers G1, G2 are allowed through into the shed defined between thread 118 and binding thread 104 of the top fabric. During this second shot the binding threads 103, 104 of the bottom fabric 200 are moved in such a way that said binding threads cross each other and a shed forms, which shed allows through a gripper G3 in order to insert a weft thread.

FIGS. 16 to 23 show the positions of a heald 13 for a Jacquard machine (similar to that shown in FIGS. 4 to 11), with five positions, namely a bottom O, a top B, and three middle positions M1, M2, M3.

The weaving loom can then weave with four grippers G1, G2, G3, G4, which are moved between B and M1, between M1 and M2, between M2 and M3, and between M3 and O respectively, or are stationary.

Figures 16, 17, 18, 19, 20, 21, 22, 23:
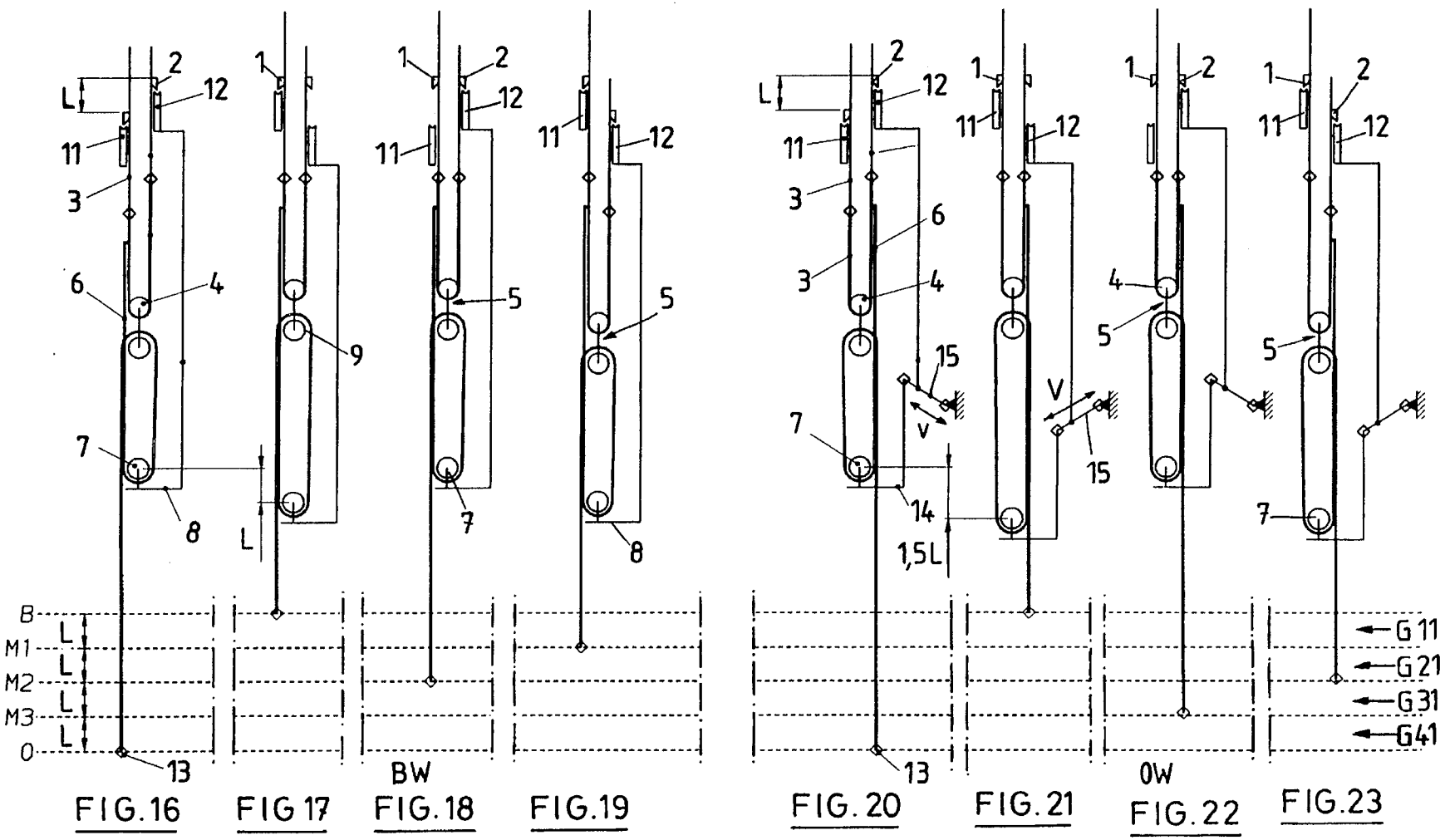
FIGS. 16 to 23 show working steps of a Jacquard machine with five positions and with four grippers.
Figure 24:
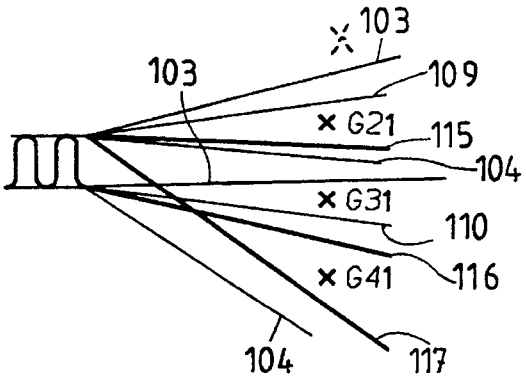
FIGS. 24 to 27 show the lie of the pile threads during weaving with the Jacquard machine with five positions.
Figure 25:
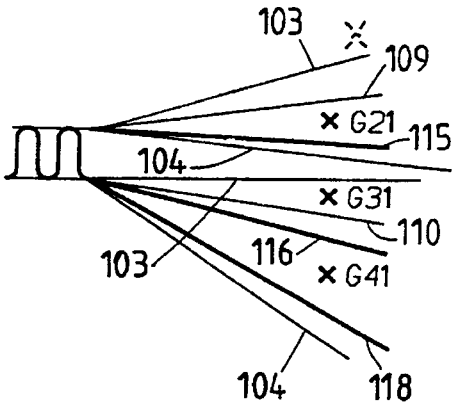
Figure 26:
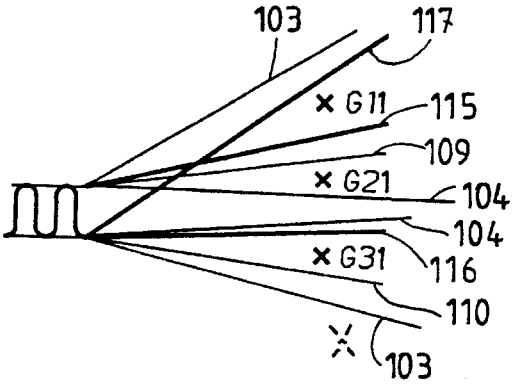
Figure 27:
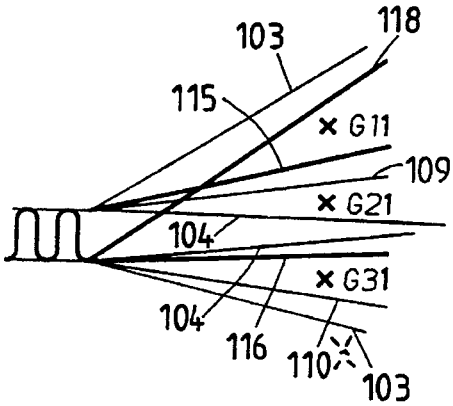

This five-position Jacquard works in the same way as the Jacquard with four positions described above. It differs from the abovementioned previous Jacquard in the following points:

—For pile threads which are provided for binding into the top fabric, grate 8 is immovably fixed to knife 12. Grate 8 thus follows the same movement as knife 12 and between shot 1 and shot 2 moves over the distance L, instead of over distance L/2 (as in FIG. 5). This means that heald 13 in the situation in FIG. 17 and in the situation in FIG. 19 is L higher than in FIGS. 5 or 7.

—For pile threads of the bottom fabric, grate 14 is connected by way of a lever system 15 to the knife 12. Grate 14 follows the movement of knife 12 with a gain factor of 3/2. Between shot 1 and shot 2 grate 14 moves over the distance 3/2 L instead of over distance L. This means that heald 13 in the situation in FIG. 21 and the situation in FIG. 23 is L higher than in FIGS. 9 or 11.

The Jacquard can thus achieve five positions:

* On shot 1 the positions O and M2 are possible for threads of the top fabric, and the positions O and M3 are possible for threads of the bottom fabric.
* On shot 2 the positions B and M1 are possible for threads of the top fabric, and the positions B and M2 are possible for threads of the bottom fabric.

Instead of four grippers, the machine can also have three grippers, which are movable vertically, i.e. the lie of the grippers G1, G2, G3 being controlled (with upgoing and downgoing grippers).

Furthermore, in that machine only one selection element per harness cord is needed to ensure that the hooks are taken into one of the five positions.

The machine with four grippers is provided with a device for inserting three weft threads per shot. On shot No. 1, grippers G21, G31 and G41 act in order to insert weft threads (one in the top fabric, and two in the bottom fabric), while on shot No. 2 grippers G11, G21 and G31 act in order to insert weft threads (two in the top fabric, and one in the bottom fabric).

The lie of the active pile threads 117, 118, tension warp threads 109, 110, binding threads 103, 104 and bound-in pile threads 115, 116 shown in FIGS. 24 to 27 is the same as the lie of the abovementioned threads in FIGS. 12 to 15.

What I claim is:

1. Jacquard machine, which when coupled with a selection device is capable of positioning pile threads in at least four positions for weaving face-to-face fabrics consisting of a first fabric and a second fabric, between which the pile threads are stretched, a first series of pile threads being provided for binding into the first fabric, and a second series of pile threads being provided for binding into the second fabric, which machine comprises:

a selection element, having:

a first set and a second set of two vertically movable knives, said two knives of each set being adapted to move in counterphase, a first set of complementary hooks per first set of knives and a second set of complementary hooks per second set of knives, said first set of complementary hooks and said second set of said complementary hooks each comprising a first hook and a second hook, said first and second sets of hooks being adapted to engage said first and second sets of knives, respectively, in one of first and second modes, whereby said hooks move with said knives in said first mode of engagement and whereby said hooks are held in a desired stationary position by said selection device in said second mode of engagement;

a first system, for weaving said first pile threads into said first fabric, said first system comprising said first set of knives, said first set of complementary hooks, a first pulley-and-cord element per first set of complementary hooks, which first pulley-and-cord element comprises:

a first movable lifting element having a top roller and a bottom roller, a first lifting cord, one end of the first lifting cord being fixed to said first hook of said first set of complementary hooks and the other end being fixed to said second hook of said first set of complementary hooks, a downward-hanging portion of said first lifting cord running under said top roller of said first movable lifting element thereby suspending said first movable lifting element, a first reversing roller, and a first position cord attached at one end to one of said first hook and said second hook of said first set of complementary hooks, a portion of said first position cord hanging below said first movable lifting element and running under said first reversing roller and running up to and over the bottom roller of said first movable lifting element, the other end of said first position cord hanging below said first reversing roller to said first series of pile threads;

a vertically movable first grate, which is below said first set of knives and to which is fixed said first reversing roller, and means for moving said first grate with one of said first set of knives; and a second system, for weaving said second pile threads into said second fabric, said second system comprising said second set of knives, said second set of complementary hooks, a second pulley-and-cord element per second set of complementary hooks, which second pulley-and-cord element comprises:

a second movable lifting element having a top roller and a bottom roller, a second lifting cord, one end of the second lifting cord being fixed to said first hook of said second set of complementary hooks and the other end being fixed to said second hook of said second set of complementary hooks, a downward-hanging portion of said second lifting cord running under said top roller of said second movable lifting element thereby suspending said second movable lifting element, a second reversing roller, and a second position cord attached at one end to one of said first hook and said second hook of said second set of complementary hooks, a portion of said second position cord hanging below said second movable lifting element and running under said second reversing roller and running up to and over the bottom roller of said second movable lifting element, the other end of said second position cord hanging below said second reversing roller to said second series of pile threads; and a vertically movable second grate, which is below said second set of knives and to which is fixed said second reversing roller; and means for moving said second grate with one of said second set of knives.

2. The machine according to claim 1, wherein said means for moving said second grate is adapted to move said second grate a distance different than that traversed by said first grate.

3. The machine according to claim 1, wherein said means for moving said second grate is adapted to move said second grate a distance different than that traversed by said second set of knives.

4. The machine according to claim 1 wherein said first position cord is attached to said first hook of said first set of complementary hooks and said second position cord is attached to said second hook of said second set of complementary hooks.

5. The machine according to claim 1 wherein said first position cord is attached to said second hook of said first set of complementary hooks and said second position cord is attached to said first hook of said second set of complementary hooks.

6. The machine according to claim 1 wherein said first position cord is attached to said first hook of said first set of complementary hooks and said second position cord is attached to said first hook of said second set of complementary hooks.

7. The machine according to claim 1 wherein said first position cord is attached to said second hook of said first set of complementary hooks and said second position cord is attached to said second hook of said second set of complementary hooks.

8. The machine according to claim 1 wherein a first plurality of the first set of knives and a first plurality of the second set of knives are fitted on a first carrier, and a second plurality of the first set of knives and a second plurality of the second set of knives are fitted on a second carrier, and further comprising a single driving means for moving said first and second carriers in counterphase with each other.

9. The machine according to claim 1, wherein said means for moving said second grate comprises:

a lever connected pivotally at one end on a shaft, a first rod, with one end connected to said one knife of said second set of knives and one end connected pivotally on said lever at a first distance from said shaft, a second rod, with one end connected to said second grate and one end connected pivotally on said lever at a second distance from said shaft, wherein said second distance differs from said first distance.

10. The machine according to claim 9, wherein a ratio of said first distance to said second distance is greater than 1.1:1.

11. The machine according to claim 9, wherein a ratio of said first distance to said second distance is less than 0.9:1.

12. The machine according to claim 10, wherein said ratio substantially equals about 1.5:1.

13. The machine according to claim 11, wherein said ratio substantially equals about 0.5:1.

14. The machine according to claim 9, further comprising a carrier connected to said one of said second set of knives wherein said first rod is rotatably connected to said carrier.

15. The machine according to claim 14, wherein a ratio of said first distance to said second distance is greater than 1.1:1.

16. The machine according to claim 14, wherein a ratio of said first distance to said second distance is less than 0.9:1.

17. The machine according to claim 15, wherein said ratio substantially equals about 1.5:1.

18. The machine according to claim 16, wherein said ratio substantially equals about 0.5:1.

19. The machine according to claim 9, wherein said first grate is adapted to move a distance L and said second grate is adapted to move a distance L/2 as said knives move said distance L.

20. The machine according to claim 9, wherein said first grate is adapted to move a distance L and said second grate is adapted to move a distance 3L/2 as said knives move said distance L.

* * * * *

UNITED STATES PATENT AND TRADEMARK OFFICE

CERTIFICATE OF CORRECTION

PATENT NO. : 5,522,435

DATED : June 4, 1996

INVENTOR(S) : Carlos DeRudder

It is certified that error appears in the above-indentified patent and that said Letters Patent is hereby corrected as shown below:

Title page, Item 54, and Column 1, line 1, "MACHINE" should read --JACQUARD MACHINE--;

Title page, Item 30, "1994" should read --1993--;

Title page, Item 56, following last line, insert:
--5,353,846 10/1994 Gheysen et al.

FOREIGN PATENT DOCUMENTS

| | | |
|---|---|---|
| 0459582 | 12/1991 | European Pat. Office |
| 0280132 | 8/1988 | European Pat. Office |
| 0106974 | 5/1984 | European Pat. Office |
| 0502528 | 9/1992 | European Pat. Office |
| 2648159 | 12/1990 | France |
| 1050774 | 5/1961 | France--; |

Column 3, line 66, "knives" (first occurrence) should read --knives 11--;

Column 4, line 1, "carrier 7" should read --carrier 16--;

Column 5, line 7, "Book" should read --Hook--;

UNITED STATES PATENT AND TRADEMARK OFFICE

CERTIFICATE OF CORRECTION

PATENT NO. : 5,522,435

DATED : June 4, 1996

INVENTOR(S) : Carlos DeRudder

It is certified that error appears in the above-indentified patent and that said Letters Patent is hereby corrected as shown below:

Column 5, line 19, "Book" should read --Hook--;

Column 5, line 21, "Book" should read --Hook--.

Signed and Sealed this

Twenty-sixth Day of November 1996

*Attest:*

*Attesting Officer*

BRUCE LEHMAN

*Commissioner of Patents and Trademarks*